United States Patent [19]

Arter et al.

[11] 4,365,423

[45] Dec. 28, 1982

[54] METHOD AND APPARATUS FOR DRYING COATED SHEET MATERIAL

[75] Inventors: Thomas C. Arter, Rochester; Eugene H. Barbee, East Rochester, both of N.Y.

[73] Assignee: Eastman Kodak Company, Rochester, N.Y.

[21] Appl. No.: 247,976

[22] Filed: Mar. 27, 1981

[51] Int. Cl.[3] ..... F26B 3/04; F26B 13/02

[52] U.S. Cl. ..... 34/23; 34/34; 34/155; 34/231; 34/233; 118/58; 427/372.2

[58] Field of Search ..... 34/155, 231, 233, 225, 34/23, 34; 427/372.2, 377; 118/58, 62, 63

[56] References Cited

U.S. PATENT DOCUMENTS

| | | | |
|---|---|---|---|
| 1,144,896 | 2/1915 | Fosbraey | 34/62 |
| 2,320,702 | 6/1943 | Marchese et al. | 154/1 |
| 3,012,335 | 12/1961 | Allander et al. | 34/155 |
| 3,287,815 | 11/1966 | Yunghahn | 34/7 |
| 3,374,106 | 3/1968 | Thygeson | 117/105.3 |
| 3,404,025 | 10/1968 | Wootten | 117/120 |
| 3,500,741 | 3/1970 | Bok | 98/115 |
| 3,508,947 | 4/1970 | Hughes | 117/34 |
| 3,525,164 | 8/1970 | Brown | 34/155 |
| 3,599,341 | 8/1971 | Darcy et al. | 34/23 |
| 3,632,374 | 1/1972 | Greiller | 117/34 |
| 3,710,758 | 1/1973 | Hoff | 118/63 |
| 4,023,472 | 5/1977 | Grunder et al. | 98/40 |
| 4,051,278 | 9/1977 | Democh | 427/326 |
| 4,061,082 | 12/1977 | Shuler | 98/40 |
| 4,064,832 | 12/1977 | Chujo et al. | 118/323 |
| 4,075,976 | 2/1978 | Clayton | 118/324 |
| 4,113,903 | 9/1978 | Choinski | 427/420 |
| 4,170,930 | 10/1979 | Lind | 98/40 |
| 4,245,397 | 1/1981 | Larr et al. | 34/155 |
| 4,287,240 | 9/1981 | O'Connor | 427/402 |

OTHER PUBLICATIONS

Pp. 250–255 from textbook, "Electrostatic Precipitation," by Sabert Oglesby, Jr. et al, published by Marcel Dekker Inc., New York, N. Y. 1978.

H. L. Dryden and G. B. Schubauer, Journal of the Aeronautical Sciences, vol. 14, No. 4, pp. 221–228, Apr. 1947.

Research Disclosure, Item 18916, Jan. 1980, published by Industrial Opportunities, Ltd., Homewell, Havant Hampshire, PO9 1EF United Kingdom.

Pp. 262–272 from textbook, "Industrial Electrostatic Precipitation," by H. J. White, published by Addison-Wesley Publishing Co., Inc., 1963.

Pp. 45.8, 45.9, 46.0, 46.1, 46.2 and 46.3 from "The Electrostatic Precipitator Manual," Chapter II, Section 8, copyright 1977, by The McIlvaine Company.

*Primary Examiner*—Larry I. Schwartz

*Attorney, Agent, or Firm*—Alfred P. Lorenzo

[57] ABSTRACT

In the drying of sheet materials which have been coated with a layer, or with two or more superposed layers, of liquid coating composition, improved drying conditions which result in less formation of mottle are provided by the use of a foraminous shield, such as a screen or perforated plate, located in close proximity to the coated surface. The sheet material, for example a web of paper or polymeric film or a succession of discrete sheets of paper or polymeric film is conveyed through a drying zone, along a predetermined path, while a gaseous drying medium, such as air maintained at an elevated temperature, which serves to promote evaporation of the liquid medium in the coating composition, is directed through the foraminous shield onto the coated surface. The foraminous shield functions to promote uniform heat transfer conditions and restricts the extent to which spent gaseous drying medium, which is discharged from the drying zone, comes into contact with the surface of the coating, thereby minimizing mottle formation. While the foraminous shield is useful in any drying operation in which mottle formation is a problem, it is especially advantageous in the drying of photographic materials, particularly those comprising one or more layers formed from coating compositions that contain volatile organic solvents.

28 Claims, 4 Drawing Figures

METHOD AND APPARATUS FOR DRYING COATED SHEET MATERIAL

FIELD OF THE INVENTION

This invention relates in general to the drying of liquid coating compositions that have been coated in the form of a layer, or in the form of two or more superposed layers, on a sheet material; for example, coating compositions that have been coated on web supports in the manufacture of photographic films and papers or in the manufacture of lithographic printing plates. More specifically, this invention relates to an improved method and apparatus for drying coated sheet materials in which the tendency for mottle formation to occur during the drying process is significantly reduced.

BACKGROUND OF THE INVENTION

In the drying of sheet materials that have been coated with a layer of liquid coating composition, it is a common practice to utilize a drying apparatus in which a gaseous drying medium, usually air that has been heated to a suitable elevated temperature, is brought into direct contact with the coated layer in order to bring about evaporation of the liquid medium from the layer. In such driers, the gaseous drying medium is directed in a manner which distributes it uniformly over the surface of the coated layer under carefully controlled conditions that are designed to result in a minimum amount of disturbance of the layer. A common type of drier utilizes a plenum into which the gaseous drying medium is admitted and from which the gaseous drying medium is discharged through a multiplicity of holes, slots or nozzles onto the surface of the layer which is to be dried. In the operation of such driers, the sheet material, which is typically in the form of a web, is continuously conveyed through the drier along a predetermined path at a suitable rate commensurate with the drying load and the operating conditions utilized; while spent gaseous drying medium—that is, gaseous drying medium which has become laden with vapor evaporated from the layer of coating composition—is continuously discharged from the drier. As the web travels through the drier, the gaseous drying medium is directed from the plenum onto the coated surface and the spent medium flows away from the path of travel to be discharged.

A wide variety of different drier designs are known to the art. Thus, for example, the drier can be designed so that the flow of spent gaseous drying medium is essentially transverse to the path of travel of the web, i.e., the spent medium flows over the edges of the web so as to exit from the drier, or so that the flow of spent medium is essentially perpendicular to the path of travel of the web. Also, while it is usually most convenient for the sheet material to be in the form of a web, it can instead be in the form of a succession of discrete sheets conveyed through the drier by suitable means such as an endless belt.

The drying of sheet materials which have been coated with two or more superposed layers is carried out in the same manner as is described above in reference to a single layer coating. To facilitate description, reference is frequently made herein to the coating and drying of a "layer" of coating composition, but it is to be understood, unless the context otherwise requires, that the discussion applies also to the coating and drying of two or more superposed layers. Moreover, the method and apparatus of the present invention find utility not only in manufacturing operations involving wet-on-wet coating techniques, but also in manufacturing operations involving sequential coating and drying steps. As will be readily understood by those skilled in the coating art, wet-on-wet coating techniques include simultaneous multi-layer coating methods, in which two or morre distinct layers are applied to a web support at the same time and the resulting multi-layer composite is dried, and methods in which distinct layers are applied separately, but in close succession and the resulting multi-layer composite is dried, i.e., a first layer is coated on the web and then a second layer is coated over the first layer while it is still in a wet state, and so forth. In contrast, in operations involving sequential coating and drying steps, a first layer is coated and dried, a second layer is coated over the first layer and dried, and so forth.

One of the most common and difficult to avoid problems that is encountered in the drying of coating compositions is the formation of mottle. It is a problem that is encountered under a wide variety of circumstances. For example, mottle, or non-uniform density, is frequently encountered when compositions consisting of solutions of a polymeric resin in an organic solvent are coated in layer form onto sheet materials, such as webs of synthetic organic plastic material. Mottle is an especially severe problem when the coating solvent is a volatile organic solvent but can occur to a significant extent even with aqueous coating compositions or with coating compositions utilizing an organic solvent of low volatility. The mottle is an undesirable defect in some instances because it detracts from the appearance of the finished product and in some instances, such as in the photographic art, it is also undesirable because it adversely affects the functioning of the coated article. Various expedients have been employed heretofore in an effort to eliminate, or at least minimize, the formation of mottle in coated layers. For example, surfactants are often added to the coating compositions as described, for example, in U.S. Pat. No. 3,514,293. These are sometimes effective in reducing mottle, but in many cases the degree to which mottle forms is still excessive in spite of the inclusion of a surfactant in the coating composition. It is believed that there are a variety of factors which can contribute to the formation of mottle and the exact mechanism of its formation is not well understood. Regardless of the specific causes of mottle, its formation in coated layers, as well as the occurrence of other defects such as streaks and lines, is a long standing problem of serious concern in the manufacture of coated materials, and especially in the manufacture of photographic products.

Among the factors which contribute to mottle formation in the drying process are non-uniform drying conditions that commonly exist in driers of the type described hereinabove. Thus, for example, turbulent flow conditions within the gaseous drying medium can result in physical disturbance of the coated layer that manifests itself as mottle in the dried product. Also, non-uniformities with respect to temperature, with respect to heat transfer rates, and with respect to the concentration of vapor in the gaseous drying medium, lead to non-uniform rates of evaporation at different points within the coated layer. The cooling which results from evaporation causes the temperature at the surface of the coated layer to decrease, so that variation in the rate of evaporation leads to the establishment of temperature differences within the layer. Such temperature differences are believed to function to induce convective flow in the layer which is a significant factor in contributing to the formation of mottle. Particular difficulty in this regard is caused by the flow of the spent gaseous drying medium in direct contact with the surface of the coated layer.

The present invention is directed toward the objective of providing an improved method and apparatus for drying coated sheet materials which reduces or eliminates many of the deficiencies in known drying methods and apparatus that contribute to the formation of mottle.

SUMMARY OF THE INVENTION

In the method of this invention, a coated sheet material is advanced along a predetermined path through a drying zone and a gaseous drying medium is uniformly directed onto the coated surface of the sheet material so as to bring about evaporation of the liquid medium in the coating, with resulting formation of spent gaseous drying medium which flows away from the path of travel for discharge from the drying zone. In order to promote uniform heat transfer conditions and reduce the degree to which flowing spent gaseous drying medium contacts the coated surface, and thereby decrease the extent of mottle formation, a foraminous shield, such as a screen or perforated plate, which is permeable to the gaseous drying medium, is positioned in opposed closely-spaced relationship with the coated surface of the sheet material. The foraminous shield serves to promote flow of the spent gaseous drying medium adjacent the surface of the shield which is remote from the coated surface and to form a quiescent region between the shield and the coated surface which is rich in the vapor of the liquid medium and in which flow of the spent gaseous drying medium is suppressed and uniform heat transfer conditions are promoted.

The foraminous shield is believed to function in several ways to reduce mottle formation. For example, it functions to diffuse currents within the gaseous drying medium and thereby protect the coated layer from turbulence which can cause physical disruption and deformation of the coated layer by impacting thereon. It also suppresses dispersion of the vapor generated by evaporation of the liquid medium to thereby form a "barrier layer" of such vapor between it and the coated surface which helps to promote the maintenance of uniform conditions of temperature and heat transfer. Of particular importance, it suppresses flow of spent gaseous drying medium directly adjacent the coated surface and tends to confine most of such flow to a region on the side of the shield which is remote from the coated surface, to thereby protect the coated layer from the creation of non-uniform conditions which lead to the formation of mottle.

Apparatus for carrying out the method of this invention includes means for advancing the coated sheet material along a predetermined path through a drying zone, such as, for example, drive means and rollers which form a typical web conveyance system, means for uniformly directing a gaseous drying medium onto the coated surface of the sheet material, and a foraminous shield which is positioned in close proximity to the path along which the sheet material travels for performing the functions described hereinabove. In order to provide the uniform flow of gaseous drying medium, for example, warm dry air, the drying apparatus typically includes a plenum which is connected to the gaseous drying medium supply means and functions to provide a controlled uniform flow of the gaseous drying medium through a multiplicity of holes, slots or nozzles. The foraminous shield, for example a screen or perforated plate which is permeable to the gaseous drying medium, is interposed between the plenum and the path in opposing spaced relationship with the wall of the plenum having the multiplicity of holes, slots or nozzles through which the gaseous drying medium flows. The foraminous shield is located in close proximity to the path, so as to form a quiescent region between it and the coated surface in which flow of the spent gaseous drying medium is suppressed and uniform heat transfer conditions are promoted, and is spaced from the opposing wall of the plenum to form a region therebetween in which flow of the spent gaseous drying medium can occur without disturbing the coated surface.

While the foraminous shield that is employed in accordance with this invention can extend over the entire length of the drier, it is not ordinarily necessary for it to do so. It performs its essential function in the initial stage of the drying process and, accordingly, is also effective when used only in the initial portion of the drier. Good results are typically achieved with the foraminous shield extending from the start of the drying zone over a distance equal to about 5 to about 25 percent of the total length of the drying zone. On the other hand, the foraminous shield should preferably be of a width which is substantially commensurate with the width of the coated surface of the sheet material, and most preferably somewhat greater than such width, in order to provide protection for the entire coated surface. Under some conditions, optimum results are achieved when a foraminous shield is also utilized in the coating zone adjacent the inlet to the drier to protect the flow of coating composition from disturbance by ambient air currents during the coating operation. Such use of a foraminous shield is described in copending commonly assigned United States patent application Ser. No. 139,506, "Coating Apparatus Provided With A Protective Shield," by Thomas R. O'Connor, filed Apr. 11, 1980 and issued Sept. 1, 1981, as U.S. Pat. No. 4,287,240, the disclosure of which is incorporated herein by reference. To achieve the maximum benefit, the foraminous shield should substantially enclose the flow of coating composition during the coating operation, should extend over the coated web in the region between the coating hopper and the drier, should extend over the coated web as it passes through the entrance slot into the drier, and should be positioned within the drier in close proximity to the path of the web over a suitable initial portion of the total length of the path.

Since the foraminous shield of this invention tends to suppress the evaporation rate by confining the evaported vapor, and thereby slows down the driving process, it should preferably not extend into the drier further than is needed to achieve the objective of reducing mottle formation. In this way, the objective of achieving relatively rapid drying in a drier of reasonable length is achieved simultaneously with the objective of solving the mottle problem.

The "drying mottle" with which this invention is concerned is closely related to, but different from, "coating mottle." The formation of coating mottle occurs, as the name indicates, in the coating zone, whereas the formation of drying mottle occurs in the drying zone. A coating process which is highly effective in alleviating coating mottle is described in Democh, U.S. Pat. No. 4,051,278 issued Sept. 27, 1977. In this process, at least two of (1) the temperature of the atmosphere in the coating zone, (2) the temperature of the coating composition at the point where it is coated on the support, and (3) the temperature of the support at the point where the coating composition is applied thereto, are maintained at a temperature substantially equivalent to the equilibrium surface temperature of the coated layer within the coating zone. The process of the U.S. Pat. No. 4,051,278 is advantageously utilized in combination with the present invention so as to minimize both coating mottle and drying mottle.

DESCRIPTION OF THE PREFERRED EMBODIMENTS

Figure 1:
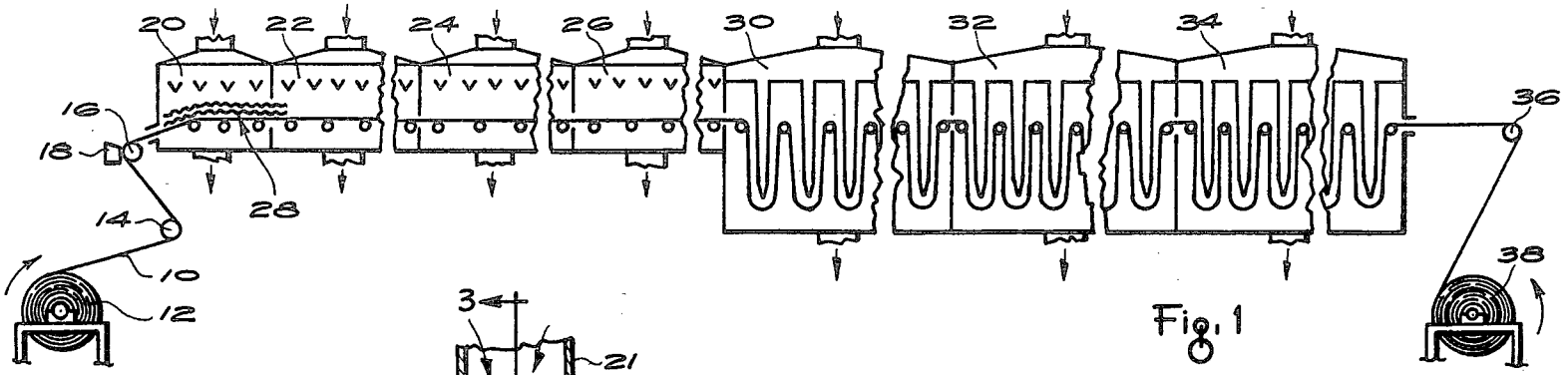
FIG. 1 is a schematic representation of the apparatus of this invention illustrating a preferred embodiment in which the foraminous shield extends over only a small portion of the total length of the drier.

The invention is described herein with particular reference to the coating and drying of photographic materials. This field of manufacture involves highly exacting specifications so that the occurrence of mottle, streaks, lines, or other defects in the coated layer is of critical concern. However, the invention is in no way limited to use in the manufacture of photographic materials and can be advantageously employed in any process, used in the manufacture of any product, in which a gaseous drying medium is utilized in the drying of a coated layer formed from a mottle-prone coating composition and in which the formation of streaks, lines, or mottle in the coating is of concern. Examples of products to whose manufacture the invention is particularly applicable include photothermographic films, dielectric recording films and lithographic printing plates.

A significant reduction in mottle can be achieved by the method of this invention in the coating and drying of any film-forming material, or mixture of film-forming materials, which can be incorporated in a coating composition which comprises an evaporable liquid medium. It is particularly advantageous in the coating and drying of solutions of polymeric resins in organic solvents because such solvents are often relatively volatile in nature and, in consequence, coatings formed therefrom are prone to mottle formation. Among the numerous examples of film-forming materials with which the invention can be advantageously employed, the following polymers are representative: acetals, acrylics, acetates, cellulosics, fluorocarbons, amides, ethers, carbonates, esters, styrenes, urethanes, sulfones, gelatins, and the like. The polymers can be homopolymers or they can be copolymers formed from two or more monomers. Liquid vehicles for use in the coating composition can be chosen from a wide range of suitable materials. For example, the coating composition can be an aqueous composition or an organic solution comprising an organic solvent. Typical organic solvents include ketones such as acetone or methyl ethyl ketone, hydrocarbons such as benzene or toluene, alcohols such as methanol or isopropanol, halogenated alkanes such as ethylene dichloride or propylene dichloride, esters such as ethyl acetate or butyl acetate, and the like. Combinations of two or more organic solvents can, of course, be utilized as the liquid vehicle or the liquid vehicle can be a mixed agueous-organic system.

The weight percentage of solids in the coating composition can be as high as ninety percent, or more, but will more tyically be in the range of about one to about twenty percent by weight. Optimum viscosity for the coating composition will depend on the type of coating apparatus employed and can be as high as 60,000 centipoise, or more, but will more typically be in the range from about 1 to about 1,000 centipoise. In addition to the film-forming material and the liquid vehicle, the coating composition can contain various optional ingredients such as pigments, surfactants, viscosity modifiers, leveling agents, antifoaming agents, and so forth. The incorporation of surfactants in the coating composition is advantageous in that they serve to reduce the surface tension of the composition and to reduce the rate of change of surface tension as a function of temperature. Accordingly, there is less force causing fluid motion as a result of temperature difference within the coated layer and, in consequence, a reduced tendency to form mottle.

Coating compositions which present particular difficulty because of their pronounced tendency to form mottle are those in which the liquid vehicle is relatively volatile, and it is with these coating compositions that the method and apparatus described herein are most useful. In particular, such compositions are those in which the liquid vehicle is an organic solvent having a boiling point at atmospheric pressure in the range of from about 40° C. to about 85° C.

The object which is coated and dried by the method of this invention can be composed of any material whatever, as long as it is a material which can be coated with a liquid coating composition. It will most typically take the form of a sheet material which is coated as a continuous web in a continuous coating process, but could also be in discrete form such as separate sheets carried through the coating and drying zones by a conveyor belt or similar device. Typical examples of useful sheet materials are polymeric films such as films of polyesters, polyolefins or cellulose esters; metal foils such as aluminum or lead foils, paper, polymer-coated paper such as polyethylene-coated paper; and laminates comprised of various layers of plastics or of plastic and metal foil.

Any suitable type of coating apparatus can be used in the method of this invention. Thus, for example, the coating composition can be coated by dip coating, air knife coating, roll coating, gravure coating, extrusion coating (for example as described in U.S. Pat No. 2,681,294), multilayer bead coating (for example as described in U.S. Pat. No. 2,761,791), curtain coating (for example as described in U.S. Pat. Nos. 3,508,497 and 3,632,374), and so forth. The coating method used can be one in which only a single layer is coated or two or more layers can be coated simultaneously. The coating speed is limited only by the limitations of the particular coating equipment employed and can be as high as 400 meters per minute, or more. Typically, coating speeds of about 10 to about 300 meters per minute would generally be employed in practicing the method described herein. Wet coverage of the coating composition is also a matter of choice and will depend upon many factors such as the type of coating apparatus employed, the characteristics of the coating composition, and the desired thickness of the coated layer after drying. Typically, wet coverages employed in the method of this invention will be in the range of from about 0.1 to about 1,000 cubic centimeters per square meter of support surface and more usually in the range of from about 5 to about 100 cubic centimeters per square meter. In the interests of decreasing the formation of mottle, it can be advantageous to utilize a high percentage of solids in the coating composition to thereby permit coating at a low wet coverage and with a high viscosity. This tends to immobilize the coating composition and thereby to reduce convective flow and minimize the formation of mottle.

The problem of mottle formation usually becomes increasingly severe as the speed of coating is increased. The reason is that as speed of coating is increased a greater quantity of liquid medium must be removed in the drier per unit of time, and this requires a greater volume of gaseous drying medium. In consequence, the gaseous drying medium must be supplied to the drying zone at a greater volumetric flow rate with resulting increased tendency to disturb the coating and cause mottle. Thus, in some instances, coating speed must be limited to that at which the level of mottle is tolerable. However, with use of the foraminous shield of this invention, it is feasible to substantially reduce the level of mottle while retaining the same coating speed or to substantially increase coating speed without any resulting increase in mottle.

As previously explained, the method and apparatus of this invention are especially useful in drying coating compositions that contain volatile organic solvents. In order to reduce the hazards associated with the drying of such compositions, it is advantageous to introduce drying air into the drier at a very high volumetric flow rate so that the average concentration of solvent in the drier will be maintained at a low level. The need for very high volumetric flow rates results in a requirement for relatively high pressures in the plenum and, as a consequence, the drying air can travel across the surface of the coated layer at relatively high velocities which can seriously disturb the coated layer. Under these circumstances, there is an especially acute need for protecting the coated layer against localized currents and the foraminous shield of this invention is very effective in performing this function. Moreover, since the foraminous shield can be located at a substantial distance from the plenum, a region of relatively large volume can exist therebetween and, accordingly, there is an adequate volume of drying air in this region at all times to keep the concentration of solvent in the air at a level far below that at which hazardous conditions could develop. In addition to facilitating safe operation of driers used to dry coatings containing volatile organic solvents, the method and apparatus of this invention are especially useful in such coating operations because the coatings are particularly prone to streaking and mottle information, and the foraminous shield greatly reduces the tendency for these defects to occur.

In the drying of coating compositions containing volatile organic solvents, the drier is typically operated under negative pressure. In this way, there is an intake of air from the surrounding atmosphere through openings in the drier, such as the web inlet and exit slots, rather than an outflow of solvent laden air from the drier to the surroundings as would occur if the drier were operated under positive pressure. The intake of air at the inlet slot tends to create turbulent conditions adjacent thereto which can be a significant factor in the formation of mottle, but the foraminous shield of this invention is highly effective in protecting the coating from such turbulence.

It is with image-forming compositions that the formation of mottle is usually the greatest problem. Thus, it is in the coating of such compositions that the present invention is usually most valuable.

In the method of this invention, gaseous drying medium passes from the plenum through the foraminous shield to contact the coated layer. At the same time, spent gaseous drying medium, containing vapor generated by evaporation of the liquid medium in the coated layer, passes through the foraminous shield in the opposite direction and flows away from the path of the web to exit from the drier. By keeping the flow of the spent gaseous drying medium substantially out of contact with the surface of the coated layer, such common defects as streaking and mottle formation are greatly reduced. It should be noted that, under typical conditions, only a small fraction of the gaseous drying medium coming from the plenum passes through the foraminous shield, since most of it flows within the region between the foraminous shield and the plenum. Thus, the concentration of solvent in this region is quite low as compared to the much higher concentration in the quiescent region between the coated surface and the foraminous shield.

An important feature of the method and apparatus of this invention is that the foraminous shield structure which is utilized functions to suppress flow of spent gaseous drying medium in contact with the surface of the coated layer while leaving the spent gaseous drying medium free to flow from the drying zone, i.e., the foraminous shield structure does not block exit of the spent gaseous drying medium from the drying zone. Thus, for example, in a typical embodiment of the apparatus, the spent gaseous drying medium is able to flow along the surface of the foraminous shield that is remote from the coated layer and pass over the edges of such surface and thereafter over the edges of the moving web to exit from the drying zone. In this respect, the invention differs in a critical manner from a drier in which the plenum is positioned very close to the surface of the moving web. In such a drier, there is only the narrow zone between the web surface and the plenum where spent drying medium can exhaust, and this narrow zone will have a very high concentration of vapor which could pose considerable hazard when the liquid medium is an organic solvent. In marked contrast, in using the method and apparatus of this invention, there can be a relatively spacious zone between the foraminous shield and the plenum in which spent drying medium can exhaust, and in this zone the concentration of vapor is sufficiently low to present little or no hazard, even with solvents which have a low explosive limit.

Use of the foraminous shield of this invention can result in some degree of suppression of the drying rate. However, this is easily accommodated by extending the length of the drier or by utilizing drying air which impinges on the side of the web opposite the coated layer as well as drying air which impinges on the surface of the coated layer. The warm air which impinges on the side of the web opposite to the coated layer is effective in introducing heat into the web to thereby promote evaporation of the liquid medium in the coated layer.

While the method of this invention is particularly useful in the coating of compositions containing organic solvents, it can also be advantageously employed in the coating of photographic materials comprising layers formed from aqueous solutions of hydrophilic colloids. Representative examples of such coating compositions are silver halide emulsions in which the hydrophilic colloid is gelatin. Coating compositions employed in the method of this invention can be of various types, such as solutions, dispersions, and suspensions. The invention is useful in the coating and drying of many types of photographic layers in addition to image-forming layes, such as, for example, subbing layers, interlayers, protective overcoat layers, antistatic layers and anti-halation layers.

The path of the sheet material within the drier is a matter of design choice and is dependent upon the particular design of drier that is best suited to accomplish the particular job involved. Generally, the sheet material is conveyed along a horizontal, or substantially horizontal, path. However, under particular conditions, it may be desirable to utilize a design in which the sheet material is conveyed along a path which is inclined from the horizontal or along a path which is vertical. If desired, the drier can utilize a flat-bed design in an initial portion thereof, in which the foraminous shield is utilized, and a festoon design in a subsequent portion.

As previously explained, the foraminous shield can extend throughout the length of the drier, but will most usually be utilized only in the initial portion, such as in a region extending over about 5 to about 25 percent of the total length of the drying zone. The foraminous shield is most effective in the initial stage of the drying process, but is also of some benefit at subsequent stages. Thus, if the design of a particular drier renders it impractical to incorporate the foraminous shield into the drier immediately adjacent to the point of entry of the web, it can be mounted within a region further along the path of travel where it can be conveniently accommodated.

The plenum can be of any design that is useful in providing the uniform distribution of gaseous drying medium that is required in driers of the type described herein. The fresh gaseous drying medium can be supplied to the plenum at a single inlet, but will more usually be supplied at several inlets depending on the length of the drier.

Air that has been heated to a suitable elevated temperature is usually used as the gaseous drying medium. However, inert gases, such as nitrogen gas, can be used in situations where the nature of the coating being dried requires their use.

The particular conditions utilized in the process of this invention will vary greatly, depending on the particular product being manufactured and the selection of optimum conditions for a given product is, in light of the disclosure herein, within the ordinary skill of the art. Factors affecting the process include the design of the foraminous shield, the thickness and composition of the coated layer or plurality of superposed layers, the speed with which the sheet material is conveyed through the drier, the design of the drier, and the volumetric flow rate, temperature, and moisture content at which the air, or other gaseous drying medium, is supplied to the drier. In optimization of the process, a key objective is to provide a uniform rate of heat transfer at all points on the coated surface. Numerous factors affect such rate of heat transfer, including the temperature and humidity of the gaseous medium, the plenum pressure, and the spacing between the plenum and the coated surface.

The shield utilized in the practice of this invention can be constructed of any suitable foraminous material. Examples of useful foraminous materials include metal screening, perforated metal plates, plastic sheeting having a multiplicity of fine holes formed therein, perforated paper, netting such as nylon or other fabric netting stretched taut within a frame, and the like.

The foraminous shield structure of this invention can be made up of a single foraminous element, e.g., a screen or perforated plate, or of a plurality, i.e., two, three or more, of spaced foraminous elements positioned in relation to one another so as to leave a relatively narrow gap therebetween. In other words, the shield structure can be of single-walled construction or of multiple-walled construction, e.g., double-walled or triple-walled.

Factors affecting the performance of the foraminous shield structure of this invention include:

(1) the size of the perforations,
(2) the spacing of the perforations,
(3) the shape of the perforations, e.g., whether they are round, square, oval, etc,
(4) whether the structure is a single-wall or multi-wall structure,
(5) the distance between the walls where it is a multi-wall structure,
(6) whether or not the perforations are aligned when it is a multi-wall structure,
(7) the thickness of the foraminous material,
(8) the edge design of the shield structure,
(9) the distance between the foraminous shield and the adjacent wall of the plenum, and
(10) the distance between the foraminous shield and the coated surface of the sheet material.

All of the above factors are matters of design choice and can be varied widely to achieve optimum results with a particular drying system.

Both the size and spacing of the perforations are very important features in determining the efficiency with which the foraminous shield structures of this invention operate. Very good results are typically obtained with perforations having a size in the range of from about 0.1 to about 5 millimeters, and more preferably in the range of from about 0.25 to about 1.25 millimeters, and with a spacing such that the percentage of open area is in the range of from about 20 to about 65 percent, and more preferably in the range of from about 30 to about 50 percent. (As used herein, size ranges specified for perforation size refer to the diameter of the perforation where it is circular and to the maximum dimension where it is of a shape other than circular. An alternative way of referring to percentage open area is by reference to the "solidity" of the shield, by which is meant the fraction of the total flow area blocked by the shield. For example, a solidity of 0.40 means 40% blocked and 60% open). In contrast with the size and spacing of the perforations, the shape of the perforations is not a particularly important parameter and, generally speaking, the perforations can be of any desired shape.

It is greatly preferred that the foraminous shield structure be a multi-walled structure, i.e., a structure with two, three or more walls. In general, the greater the number of walls the more efficient the structure. However, under typical conditions, a double-walled shield structure is so efficient that the added cost and complexity of constructing a triple-walled structure would not be justified even though the triple-walled structure would be somewhat more effective. There is usually little to be gained in terms of improved performance by having more than three walls. When two or more walls are used, the distance by which they are spaced from one another is an important design factor. Preferably, the walls are spaced apart a distance in the range of from about 0.1 to about 10 centimeters, and most preferably a distance in the range of from about 0.3 to about 1 centimeters. In multi-wall structures, the degree to which the perforations of one wall align with the perforations of an adjacent wall is also a design factor affecting the overall performance of the shield structure, and it is usually desirable that the perforations be positioned so that they are out of alignment with those of the adjacent wall. Construction of a type in which the spaced walls are parallel to one another is generally satisfactory, but they can also be positioned in non-parallel relationship if desired.

In using multi-wall shield structures, it is sometimes advantageous for the structure to be designed so that the size of the perforations diminishes progressively, with the outermost wall, which is closest to the adjacent plenum wall, having the largest perforations and the innermost wall, which is closest to the surface of the coated layer, having the smallest perforations. For example, a multi-wall shield structure could be comprised of an outermost wall having perforations with a size of 1.5 millimeters, an intermediate wall having perforations with a size of 1 millimeter, and an innermost wall, which would be located closest to the surface of the coated layer, having perforations with a size of 0.5 millimeters.

The thickness of the foraminous material from which the shield is formed is also a significant factor in determining operating effectiveness. Generally speaking, it is desirable that the foraminous material be as thin as is practical since, all other factors being equal, a thin material is more effective than a thick one in reducing turbulence. Good results are typically obtained using foraminous materials with a thickness of less than about 2 millimeters. Thus, whether the shield is constructed from a woven wire screen, in which the thickness is dependent on the diameter of the wire from which the screen is formed, or from a perforated plate material, it is usually advantageous for its thickness to be below the specified value of about 2 millimeters.

The edge design of the foraminous shield can also affect its performance. Thus, for example, it is preferred that the shield extend somewhat beyond the edges of the coated layer to avoid disturbance of the coated layer resulting from "edge-effect" turbulence. As an alternative to extending the shield beyond the edges of the coated layer, it can be angled sharply downward along its edges.

Perhaps the most important of all the design factors relating to the foraminous shield are the distances between the foraminous shield and the adjacent plenum wall and between the foraminous shield and the surface of the coated layer. The optimum distances are determined by many factors, including the pressure at which the drying medium is delivered, the size of the perforations, the number of walls, the percentage of open area, and so forth. Under typical conditions, good results are obtained with a spacing between the foraminous shield and the adjacent plenum wall in the range of from about 5 to about 100 centimeters, and a spacing between the foraminous shield and the surface of the coated layer in the range of from about 1 to about 15 centimeters.

In the apparatus of this invention, the foraminous shield is positioned in close proximity to the surface of the coated layer, but it is often advantageous for it to be relatively widely spaced from the plenum. For example, in those instances in which the vapors generated in the drying process are explosive, it is desirable that the distance between the foraminous shield and the adjacent plenum wall be large relative to the distance between the foraminous shield and the surface of the coated layer, so as to maintain an average vapor concentration which is at a safe low level. Under such circumstances, it is preferred that these distances be in a ratio in the range of from about 2 to 1 to about 20 to 1 and more preferably, in the range of from about 4 to 1 to about 20 to 1.

A particular advantage of the use of a foraminous shield in accordance with this invention is that the air or other gaseous drying medium can be supplied from the plenum at a greater pressure, without detrimentally affecting the coating, than would be feasible without the use of the foraminous shield. The delivery of a greater volumetric flow of air that results from such increased pressure means that the percentage of vapor in the spent air is lower. This is highly advantageous in dealing with potentially hazardous vapors, such as those generated by organic solvents, since it provides a greater margin of safety in keeping well below the explosive limits.

While reference is frequently made herein to a "drying zone," it is to be understood that such zone can, and often will, be comprised of a series of sub-zones, each of which provides different drying conditions. For example, the drying zone may consist of a series of sub-zones utilizing progressively higher temperatures. Such practices are well established, and their purposes clearly understood in the coating and drying arts.

The method and apparatus of this invention are useful in a wide variety of processes. For example, they are useful in the drying of either single-layer or multiple-layer coatings; in the drying of non-settable coatings; in the drying of settable coatings by various processes including those in which a chill-setting zone is used in association with a drying zone; and in either or both of the drying steps of a sequential coating process in which a single or multiple-layer coating is applied over a previously applied and dried single or multiple-layer coating.

Referring now to the drawings, FIG. 1 schematically illustrates a drier equipped with a foraminous shield in accordance with this invention. As shown in FIG. 1, the sheet material which is coated is a continuous web 10 which is unwound from supply roll 12 and passes around guide roller 14 and then over coating roll 16 where it is coated with a plurality of layers of coating composition by coating hopper 18. In the coating of compositions containing organic solvents, the coating hopper would typically be enclosed within a chamber in order to keep the solvent from passing into the surrounding environment and to provide effective temperature control during the coating process, but in coating aqueous compositions, such a chamber is generally unnecessary. Immediately after being coated, web 10 passes through a series of drying chambers 20, 22, 24 and 26 in each of which warm dry air is uniformly impinged on the coated layers to effect drying thereof. The chambers 20, 22, 24 and 26 together define a first drying zone, and since this zone can comprise additional similar chambers to provide a sufficiently long path of travel for web 10, the series of chambers is illustrated as being broken at several places. A foraminous shield 28, composed of stainless steel screening mounted in close proximity to the path of web 10 and just above the coated surface thereof, extends throughout chamber 20 and partially into chamber 22. Web 10 moves rapidly through drying chamber 20 with the coated surface thereof spaced from, but in close proximity to, the opposing surface of stationary foraminous shield 28 to thereby create a quiescent zone, i.e., a zone in which there are no turbulent flow conditions, which is rich in the vapor resulting from evaporation of the liquid medium in the coating. After passing through the first drying zone defined by chambers 20, 22, 24 and 26, web 10 passes through a second drying zone defined by chambers 30, 32 and 34. Since the second drying zone can comprise additional similar chambers to extend the path of travel of web 10, this series of chambers is also illustrated as being broken at several places. The first drying zone functions to carry out the major portion of the drying of the coated layers, while the second drying zone serves to remove small amounts of residual liquid medium remaining in the coated layers and to remove liquid medium that has penetrated into web 10. As illustrated, the drying chambers in the first drying zone are of a flat-bed design while those in the second drying zone are of a festoon design in order to provide an extended residence time. After leaving the second drying zone, web 10 passes around guide roll 36 and is wound onto take-up roll 38.

Figure 2:
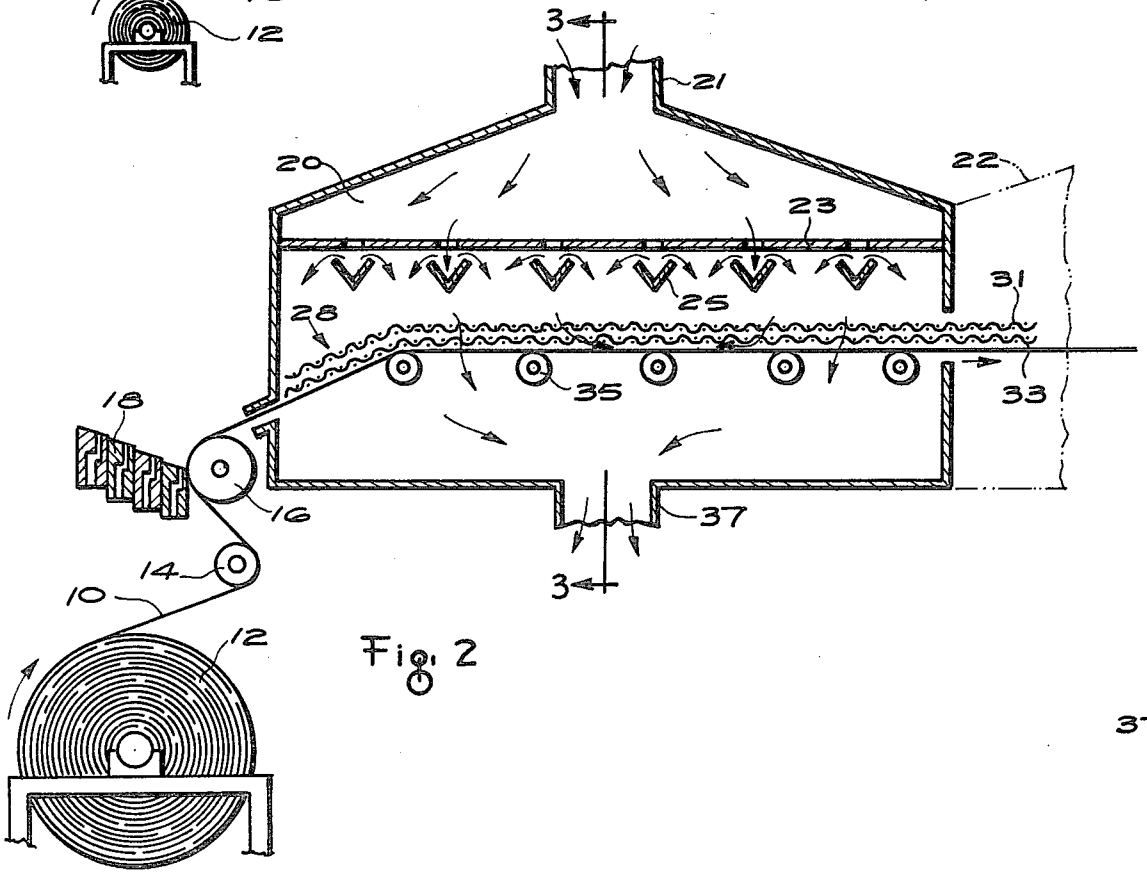
FIG. 2 is a representation to a larger scale of the first section of the drier of FIG. 1 illustrating in more detail the positioning and function of the foraminous shield.

FIG. 2 is an enlarged representation of drying chamber 20 which better illustrates the flow path of the drying air in relation to foraminous shield 28. As shown in FIG. 2, warm dry air is admitted to chamber 20 through inlet duct 21 and passes through distributing plate 23 beneath which are mounted a plurality of V-shaped baffles 25. The combined functioning of distributing plate 23 and baffles 25 serves to provide a uniform distribution of the air and to minimize the formation of air currents. Foraminous shield 28, which is comprised of upper and lower screen elements 31 and 33, is co-extensive in width with web 10 and mounted in a position in which it is parallel to the closely adjacent coated surface of web 10. The mounting of shield 28 is such as to permit precise up and down movement so that it can be adjusted to set an optimum spacing in relation to web 10. As web 10 travels through chamber 20 along a horizontal path defined by a plurality of guide rollers 35, a quiescent zone which is rich in solvent vapor is formed between the lower surface of screen element 33 and the surface of the coating on web 10. Spent gaseous drying medium flows transversely of the path of web 10 in the region between screen element 31 and distributing plate 23 and passes over the edges of web 10 to exit from chamber 20 via exit duct 37. Within the quiescent solvent-rich zone between screen element 33 and the coated surface of web 10, transverse flow of spent drying air is suppressed and the establishment of uniform heat transfer conditions is promoted.

Figure 3:
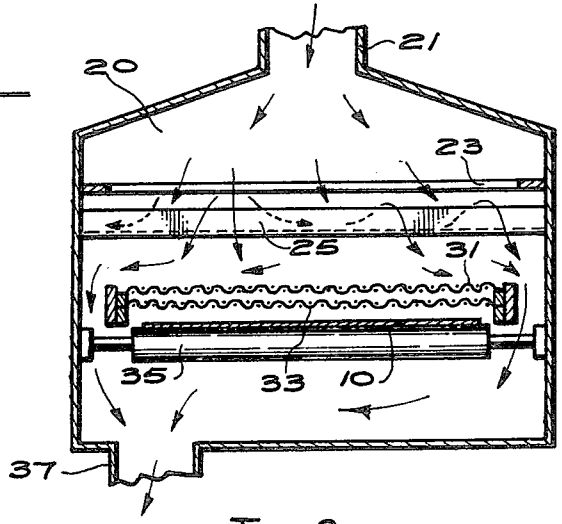
FIG. 3 is a section taken along line 3—3 of FIG. 2.

As most clearly seen in FIG. 3, fresh drying air passes through distributing plate 23 and over the edges of baffles 25 to provide a steady, uniform, low velocity flow which promotes uniform drying. Spent drying air flows transversely of the path of web 10 and over the edges of web 10 to exit from duct 37.

Figure 4:
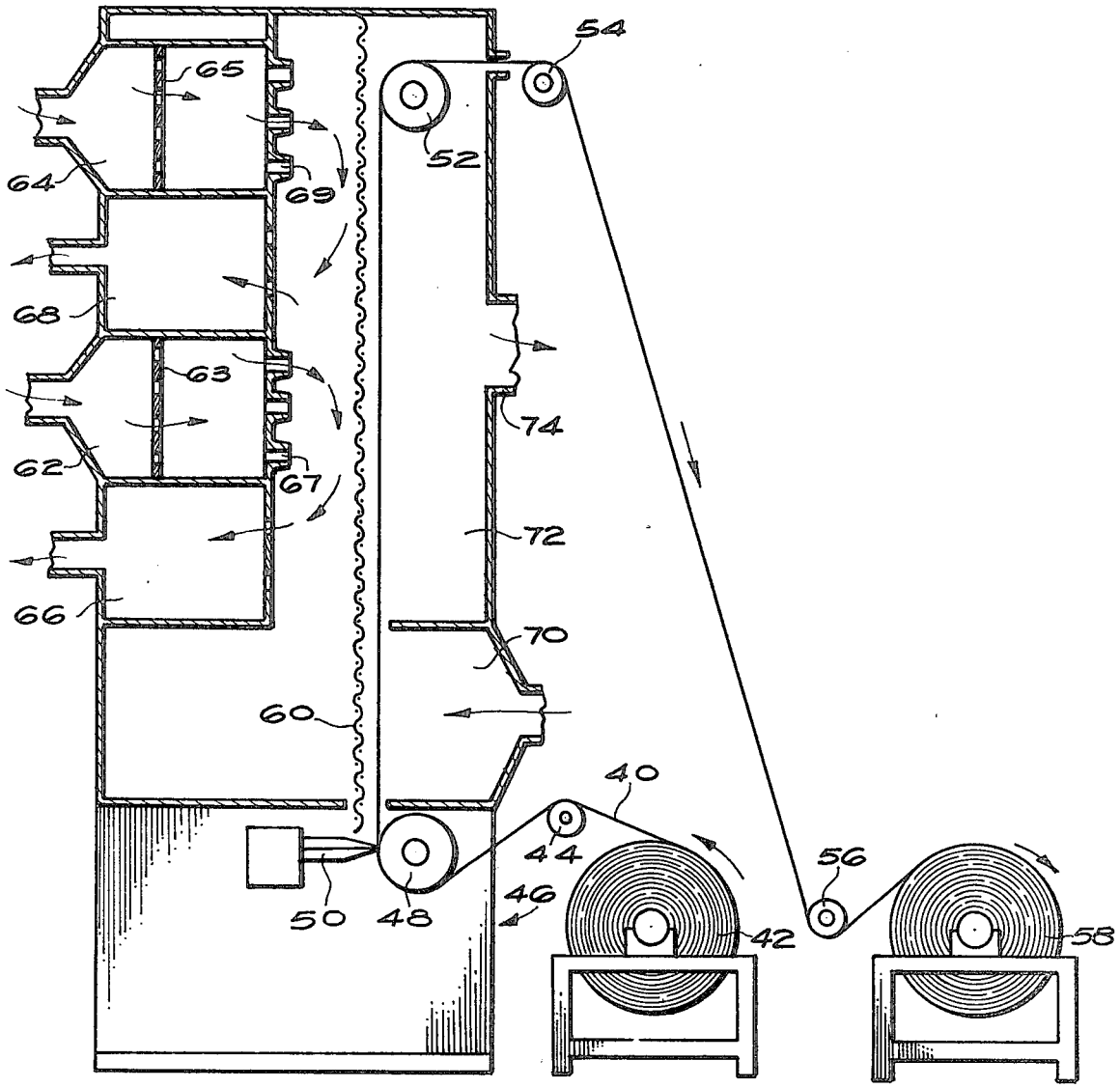
FIG. 4 illustrates a further alternative embodiment of the invention in which the web travels within the drier along a vertical path rather than the horizontal path illustrated in FIG. 1.

FIG. 4 illustrates a drier of different design than that shown in FIGS. 1 to 3. As shown in FIG. 4, web 40 is unwound from supply roll 42 and passes around guide roller 44 into coater-drier 46 and then over coating roll 48 where it is coated with a layer of organic-solvent-containing coating composition by extrusion hopper 50. After being coated, web 40 travels vertically upward, over guide roller 52, through the wall of coater-drier 46, over guide rollers 54 and 56 and onto take-up roll 58. As web 10 passes between coating roll 48 and guide roller 52, it travels with its coated surface in close proximity to foraminous shield 60 which is composed of a single layer of stainless steel screening. Drying air is supplied via chambers 62 and 64, each of which is connected to a suitable blower (not shown), and exhausted via chambers 66 and 68 each of which is connected to a suitable vacuum source. Drying air admitted to chambers 62 and 64, passes through distributing plates 63 and 65, respectively, and then through a plurality of nozzles 67 and 69, respectively, so as to provide a uniform gentle flow of air. Warm drying air is also introduced into chamber 70 by a blower (not shown) where it impinges onto the uncoated surface of web 10 and thereby provides heat to web 10 which assists in bringing about evaporation of the solvent in the coated layer. As well as exhausting through chambers 66 and 68, spent drying air is also exhausted through chamber 72 via discharge duct 74 which is connected to a suitable vacuum source. As web 40 passes through the drying zone, a quiescent solvent-rich zone is formed between shield 60 and the coated surface of web 40 in which flow of spent drying air is suppressed and the establishment of uniform heat transfer conditions is promoted.

A drier of the type illustrated in FIGS. 1 to 3 is particularly useful in drying a coated web which requires a prolonged residence time, as is often the case where the web material is of such a nature that the coating composition is able to penetrate into it, for example a paper web. A drier of the type illustrated in FIG. 4 is particularly useful in drying a coating composition which is relatively viscous and is applied as a very thin layer, so that it has no tendency to run during the vertical travel through the drier, and which does not penetrate into the web so that drying can be carried out with a brief residence time, for example the coating of an aluminum support with an organic polymeric composition in the manufacture of lithographic printing plates. Many other types of driers can, of course, be utilized with equal effectiveness in putting the principles of this invention into practice.

Use of the present invention in combination with the invention disclosed and claimed in the aforementioned copending U.S. patent application Ser. No. 139,506, the disclosure of which is incorporated herein by reference, is often advantageous. In this regard, the foraminous shield can be constructed as a single element which substantially encloses the coating apparatus, to protect the coating operation from disturbance by ambient air currents, and which extends into the drier through the web entrance slot. In this way, the foraminous shield protects the coating operation, protects the coated web as it traverses the distance from the coating apparatus to the drier entrance, protects the coated web in the critical region surrounding the entrance slot where turbulent conditions frequently tend to arise, and protects the coated web during the drying operation. The foraminous shield need not, of course, be of the same construction throughout to be used in this way. For example, it could be of double-walled construction in the region surrounding the coating apparatus but of single-walled construction within the drier itself, or the perforations in the foraminous shield could be of a size and spacing in the region surrounding the coating operation that is best suited for the purpose of protecting the flow of coating composition but of a different size and spacing in the region that is located within the drier so as to provide optimum conditions for the drying operation.

Use of both the method of copending U.S. patent application Ser. No. 139,506 and the method of U.S. Pat. No. 4,051,278 in conjunction with the method of the present invention is often highly advantageous where it is important to achieve a very low level of mottle.

While the term "foraminous shield" is believed to be aptly descriptive of the device described herein, it could also be referred to as a "diffusion means" or as a "flow controlling means."

The invention is further illustrated by the following examples of its practice.

EXAMPLE 1

Coating and drying apparatus similar to that shown in FIG. 4 herein was used in the preparation of a lithographic printing plate. In preparing the printing plate, an anodized aluminum web having a thickness of 0.00381 millimeters was coated at a web speed of 45.7 cm/sec with a 10 percent by weight solution of a light-sensitive polymeric resin dissolved in methylene chloride. The coating composition was applied at a wet coverage of 26.91 cc/m$^2$. After passing the coating hopper, the web travelled a distance of about one meter within the coating compartment, and then passed through a slot into a drier composed of four chambers each about 0.3 meters in length. Drying of the coating was complete by the time the web left the fourth chamber, except for a small amount of residual solvent which was removed in a subsequent curing section.

Variables investigated in this example were the temperature of the aluminum support at the coating application point, the drier temperature, the pressure of air impingement, the air velocity through the slot between the coating compartment and the drier, and the use of a foraminous shield. Both single-wall and double-wall foraminous shields were utilized, with the shield, in each case, extending over the coated surface of the web from the coating hopper through the end of the fourth drying chamber, and being positioned at a distance of 2.6 cm from the surface of the coating and 7.6 cm from the adjacent wall of the plenum. The single-wall foraminous shield was formed from 20×20 mesh (per square centimeter) stainless steel screen composed of 0.023 cm diameter wire. The double-wall foraminous shield was formed from the same stainless steel screen with a 0.5 cm spacing between the walls. The test samples were visually inspected after drying and rated for mottle in accordance with a numerical rating scale in which 0 represents substantially no observable mottle and 10 represents severe mottle.

The conditions utilized and the results obtained are summarized in Table I below.

TABLE 1

| Test No. | Type of Shield | Support Temperature (°C.) | Drier Temperature (°C.) | Pressure in Drying Chambers (Pascals) No. 1 | No. 2 | No.3 | No. 4 | Slot Velocity (cm/sec) | Mottle Rating |
|---|---|---|---|---|---|---|---|---|---|
| 1 | None | 38 | 60 | −50 | 50 | −50 | 50 | 355 | 9 |
| 2 | None | 38 | 60 | −50 | 50 | −50 | 50 | 559 | 8.5 |
| 3 | None | 38 | 60 | 0 | 50 | 0 | 50 | 355 | 10 |
| 4 | None | 38 | 21 | −50 | 50 | −50 | 50 | 355 | 8 |
| 5 | None | 21 | 21 | −50 | 50 | −50 | 50 | 355 | 5 |
| 6 | Single-Wall | 38 | 60 | −50 | 50 | −50 | 50 | 355 | 4 |
| 7 | Double-Wall | 38 | 60 | −50 | 50 | −50 | 50 | 355 | 3 |
| 8 | Double-Wall | 38 | 21 | −50 | 50 | −50 | 50 | 355 | 3 |
| 9 | Double-Wall | 21 | 21 | −50 | 50 | −50 | 50 | 355 | 2 |
| 10 | Double-Wall | 38 | 60 | −50 | 175 | −50 | 175 | 355 | 3.5 |
| 11 | None | 21 | 21 | −50 | 175 | −50 | 175 | 355 | 7 |

As indicated by the results reported in Table I, increasing slot velocity (compare test 1 with test 2) and decreasing drier temperature (compare test 1 with test 4) results in moderate improvement in the degree of mottle formation. Also, control of the support temperature and drier temperature in accordance with the principles of U.S. Pat. No. 4,051,278 (compare test 4 with test 5) brings about a significant improvement. On the other hand, increasing air impingement pressure (compare test 5 with test 11) causes a substantial increase in the degree of mottle formation.

Incorporation into the drier of a single-wall foraminous shield (compare test 1 with test 6) greatly improves the results obtained with respect to mottle formation. Even better results are achieved with use of a double-wall foraminous shield (compare test 6 with test 7) and such a shield is effective even under conditions of high air impingement pressure (see test 10). Optimum results were obtained when the principles of U.S. Pat. No. 4,051,278 were utilized in combination with the use of the foraminous shield of this invention (see test 9).

EXAMPLE 2

Coating and drying apparatus having an enclosed coating zone, and a horizontally-disposed flat-bed drier similar to that shown in FIG. 1 herein, was used to coat a poly(ethylene terephthalate) web with a coating composition comprising a 10 percent by weight solution of a light-sensitive polymeric resin dissolved in methylene chloride. The web was coated at a speed of 15.2 cm/sec and the coating composition was applied at a wet coverage of 75.6 cc/m$^2$. The time in the coating zone was 1.9 seconds, while the total time from the coating application point to the dry point was 27 seconds. The temperature in the drier was 93° C.

Variables investigated in this example were air impingement pressure and the use of a foraminous shield. Both single-wall and double-wall foraminous shields were utilized, and these shields were constructed in the same manner and of the same material as used in Example 1. In each case, the shield was positioned at a distance of 2.5 cm from the surface of the coating, and 7.5 cm from the adjacent wall of the plenum. Variations tested included the use of a shield in the coating zone and the use of a shield in the first and/or second sections of the drier. The residence time for the web in each of the first and second sections of the drier was 5.2 seconds.

The conditions utilized and the results obtained are summarized in Table II below.

TABLE II

| Test No. | Type of Shield: Coating Zone | Section 1 of Drier | Section 2 of Drier | Air Impingement Pressure (Pascals) | Heat Transfer Coefficient (Joules/ $m^2$ sec °C.)(1) | Mottle Rating |
|---|---|---|---|---|---|---|
| 1 | None | None | None | 250 | 115 | 10 |
| 2 | None | None | None | 125 | 104 | 9 |
| 3 | None | None | None | 63 | 93 | 7.5 |
| 4 | Single-Wall | None | None | 125 | 104 | 6 |
| 4 | Single-Wall | Single-Wall | None | 125 | 99 | 4 |
| 6 | Single-Wall | Single-Wall | Single-Wall | 125 | 95 | 3.5 |
| 7 | None | Single-Wall | Single-Wall | 125 | 95 | 7 |
| 8 | Double-Wall | Double-Wall | Double-Wall | 125 | 86 | 2 |
| 9 | Double-Wall | Double-Wall | None | 125 | 95 | 3 |
| 10 | Double-Wall | Double-Wall | Double-Wall | 250 | 86 | 3 |

(1)Estimated average heat transfer coefficient for drier sections 1 and 2.

As indicated by the results reported in Table II, a decrease in air impingement pressure results in an improvement in mottle (compare test 1 with test 3). Use of the foraminous shield substantially reduces mottle with best results being achieved where the shield is utilized close to the coating point (compare test 6 with test 7). The double-wall shield provides a significant improvement in performance as compared with the single-wall shield (compare test 6 with test 8).

EXAMPLE 3

In this example, the same coating composition, web and apparatus as are described in Example 2 were used to evaluate the effect of variation in the size of the perforations in the foraminous shield. Two types of shields were used, the first being a single-wall shield formed of the same 20×20 mesh stainless steel screen that was used in Examples 1 and 2 and the second being a single-wall shield formed of a 9.5×9.5 mesh stainless steel screen composed of 0.036 cm diameter wire. In each case, the screen was positioned at a distance of 2.6 cm from the surface of the coating, and 6.4 cm from the adjacent wall of the plenum. The drier was operated at a temperature of 82° C. and an air impingement pressure of 125 Pascals.

The conditions utilized and the results obtained are summarized in Table III below:

TABLE III

| Test No. | Type of Shield: Coating Zone | Section 1 of Drier | Section 2 of Drier | Mottle Rating |
|---|---|---|---|---|
| 1 | None | None | None | 10 |
| 2 | 20 × 20 | None | None | 6 |
| 3 | 20 × 20 | 20 × 20 | None | 4 |
| 4 | 20 × 20 | 20 × 20 | 20 × 20 | 4 |
| 5 | 9.5 × 9.5 | None | None | 8 |
| 6 | 9.5 × 9.5 | 9.5 × 9.5 | None | 6 |
| 7 | 9.5 × 9.5 | 9.5 × 9.5 | 9.5 × 9.5 | 5.5 |

As indicated by the data reported in Table III, both types of screen provide a significant improvement in mottle, but the 20×20 screen, which is of finer mesh, is more effective than the 9.5×9.5 screen.

While applicants are not sure of the exact mechanisms whereby their invention functions, it is apparent that the use of a foraminous shield, such as a screen or perforated plate, in close proximity to the surface of a coating, which is undergoing drying by a flowing gaseous medium, provides drying conditions which result in less formation of mottle, particularly with coating compositions that contain volatile organic solvents. This is an entirely unexpected result and provides a simple and easily implemented solution to the problem of mottle formation which has long plagued the coating industry, and especially that portion of the industry involved with the coating of photographic materials.

The invention has been described in detail with particular reference to preferred embodiments thereof, but it will be understood that variations and modifications can be effected within the spirit and scope of the invention.

We claim:

1. In a method for drying a sheet material which has been coated on a surface thereof with at least one layer of a mottle-prone coating composition containing a liquid medium that is capable of being evaporated from said coating composition by contact with a gaseous drying medium, said method comprising the steps of advancing said coated sheet material along a predetermined path through a drying zone and uniformly directing a gaseous drying medium onto the coated surface of said sheet material so as to bring about evaporation of said liquid medium with resulting formation of spent gaseous drying medium which flows away from said path for discharge from said drying zone; the improvement which comprises advancing said sheet material with said coated surface in opposed closely spaced relationship with a foraminous shield which is permeable to said gaseous drying medium, so as to promote flow of said spent gaseous drying medium adjacent to the surface of said shield which is remote from said coated surface and to form a quiescent region between said shield and said coated surface which is rich in the vapor of said liquid medium and in which flow of said spent gaseous drying medium is suppressed and uniform heat transfer conditions are promoted, whereby formation of mottle in said coating is reduced.

2. A method as claimed in claim 1 wherein said sheet material is a synthetic organic polymeric film.

3. A method as claimed in claim 1 wherein said sheet material is a poly(ethylene terephthalate) film.

4. A method as claimed in claim 1 wherein said liquid medium comprises an organic solvent.

5. A method as claimed in claim 1 wherein said liquid medium comprises an organic solvent having a boiling point at atmospheric pressure of from about 40° C. to about 85° C.

6. A method as claimed in claim 1 wherein said gaseous drying medium is warm dry air.

7. A method as claimed in claim 1 wherein said coating composition is a photographic coating composition.

8. A method as claimed in claim 1 wherein said foraminous shield is a single-walled structure.

9. A method as claimed in claim 1 wherein said foraminous shield is a multi-walled structure, each wall of which is comprised of a foraminous material.

10. A method as claimed in claim 1 wherein said foraminous shield is composed of screen material.

11. A method as claimed in claim 1 wherein said foraminous shield is composed of perforated plate material.

12. A method as claimed in claim 1 wherein said foraminous shield is composed of foraminous material having perforations with a size in the range of from about 0.25 to about 1.25 millimeters and a percentage open area in the range of from about 30 to about 50 percent.

13. A method as claimed in claim 1 wherein said foraminous shield extends from the start of said drying zone over a distance equal to about 5 to about 25 percent of the total length of said drying zone.

14. A method as claimed in claim 1 wherein said coated sheet material is a web comprised of aluminum coated with a layer of a coating composition adapted to form a lithographic printing plate, said coating composition comprising a light-sensitive polymeric resin dissolved in an organic solvent.

15. In a method for drying a web which has been coated on a surface thereof with at least one layer of a mottle-prone coating composition containing a liquid medium that is capable of being evaporated from said coating composition by contact with a gaseous drying medium, said method comprising the steps of advancing said coated web along a predetermined path through a drying zone and uniformly directing a gaseous drying medium onto the coated surface of said web so as to bring about evaporation of said liquid medium with resulting formation of spent gaseous drying medium which flows transversely to said path for discharge from said drying zone; the improvement which comprises advancing said sheet material with said coated surface in opposed closely spaced relationship with a foraminous shield which is substantially commensurate in width with said coated surface and permeable to said gaseous drying medium, so as to promote transverse flow of said spent gaseous drying medium adjacent to the surface of said shield which is remote from said coated surface and to form a quiescent region between said shield and said coated surface which is rich in the vapor of said liquid medium and in which transverse flow of said spent gaseous drying medium is suppressed and uniform heat transfer conditions are promoted, whereby formation of mottle in said coating is reduced.

16. A method for reducing mottle in the drying of a coated sheet material, said sheet material having been coated on a surface thereof with at least one layer of a mottle-prone coating composition containing a liquid medium that is capable of being evaporated from said coating composition by contact with a gaseous drying medium, and said drying being carried out by the steps of advancing said coated sheet material along a predetermined path through a drying zone and uniformly directing a gaseous drying medium onto the coated surface of said sheet material so as to bring about evaporation of said liquid medium with resulting formation of spent gaseous drying medium which flows away from said path for discharge from said drying zone; said method comprising interposing a foraminous shield, which is permeable to said gaseous drying medium, in opposed closely spaced relationship with said coated surface so as to promote flow of said spent gaseous drying medium adjacent to the surface of said shield which is remote from said coated surface and to form a quiescent region between said shield and said coated surface which is rich in the vapor of said liquid medium and in which flow of said spent gaseous drying medium is suppressed and uniform heat transfer conditions are promoted, whereby formation of mottle in said coating is reduced.

17. Apparatus for drying a sheet material which is coated on a surface thereof with at least one layer of a mottle-prone coating composition containing a liquid medium that is capable of being evaporated from said coating composition by contact with a gaseous drying medium, said apparatus comprising:

means for advancing said coated sheet material along a predetermined path through a drying zone, means adjacent to said path for uniformly supplying a gaseous drying medium to said coated surface so as to bring about evaporation of said liquid medium with resulting formation of spent gaseous drying medium which flows away from said path for discharge from said drying zone, and shield means for reducing the tendency for mottle formation in said coating, said shield means being comprised of a foraminous material which is permeable to said gaseous drying medium and being interposed between said path and said supply means in close proximity to said coated surface, so as to promote flow of said spent gaseous drying medium adjacent to the surface of said shield means which is remote from said coated surface and form between said coated surface and said shield means a quiescent region which is rich in the vapor of said liquid medium and in which flow of said spent gaseous drying medium is suppressed and uniform heat transfer conditions are promoted, whereby formation of mottle in said coating is reduced.

18. Apparatus for drying a sheet material which is coated on a surface thereof with at least one layer of a mottle-prone coating composition containing a liquid medium that is capable of being evaporated from said coating composition by contact with a gaseous drying medium, said apparatus comprising:

means for advancing said coated sheet material along a predetermined path through a drying zone, means for supplying said gaseous drying medium to said drying zone, a plenum which is located within said drying zone adjacent to said path and is connected to said supply means, said plenum serving to uniformly direct said gaseous drying medium onto the coated surface of said sheet material so as to bring about the evaporation of said liquid medium with resulting formation of spent gaseous drying medium which flows away from said path for discharge from said drying zone, and a foraminous shield which is interposed between said plenum and said path, said shield being permeable to said gaseous drying medium and having one surface thereof in opposing spaced relationship with said plenum and the opposite surface thereof in opposing spaced relationship with said path, said shield being in close proximity to said path, so as to form a quiescent region between said shield and said coated surface which is rich in the vapor of said liquid medium and in which flow of said spent gaseous drying medium is suppressed and uniform heat transfer conditions are promoted, and being spaced from said plenum to form a region therebetween in which flow of said spent gaseous drying medium can occur without disturbing said coated surface, whereby formation of mottle in said coating is reduced.

19. Apparatus as claimed in claim 18 wherein said foraminous shield is a single-walled structure.

20. Apparatus as claimed in claim 18 wherein said foraminous shield is a multi-walled structure, each wall of which is comprised of a foraminous material.

21. Apparatus as claimed in claim 18 wherein said foraminous shield is composed of screen material.

22. Apparatus as claimed in claim 18 wherein said foraminous shield is composed of perforated plate material.

23. Apparatus as claimed in claim 18 wherein said foraminous shield is composed of foraminous material having perforations with a size in the range of from about 0.25 to about 1.25 millimeters and a percentage open area in the range of from about 30 to about 50 percent.

24. Apparatus as claimed in claim 18 wherein the spacing between said foraminous shield and the opposing surface of said plenum is in the range of from about 5 to about 100 centimeters.

25. Apparatus as claimed in claim 18 wherein the spacing between said foraminous shield and said path is in the range of from about 1 to about 15 centimeters.

26. Apparatus as claimed in claim 18 wherein the ratio between (1) the spacing between said foraminous shield and the opposing surface of said plenum, and, (2) the spacing between said foraminous shield and said path, is in the range of from about 4 to 1 to about 20 to 1.

27. Apparatus as claimed in claim 18 wherein said foraminous shield extends from the start of said drying zone over a distance equal to about 5 to about 25 percent of the total length of said drying zone.

28. Apparatus for drying a web which is coated on a surface thereof with at least one layer of a mottle-prone coating composition containing a liquid medium that is capable of being evaporated from said coating composition by contact with a gaseous drying medium, said apparatus comprising:

means for advancing said coated web along a predetermined path through a drying zone, means for supplying said gaseous drying medium to said drying zone, a plenum which is located within said drying zone adjacent to said path and is connected to said supply means, said plenum serving to uniformly direct said gaseous drying medium onto the coated surface of said web so as to bring about the evaporation of said liquid medium with resulting formation of spent gaseous drying medium which flows transversely to said path for discharge from said drying zone, and a foraminous shield which is substantially commensurate in width with said coated surface interposed between said plenum and said path, said shield being permeable to said gaseous drying medium and having one surface thereof in opposing spaced relationship with said plenum and the opposite surface thereof in opposing spaced relationship with said path, said shield being in close proximity to said path, so as to form a quiescent region between said shield and said coated surface which is rich in the vapor of said liquid medium, and in which transverse flow of said spent gaseous drying medium is suppressed and uniform heat transfer conditions are promoted, and being spaced from said plenum to form a region therebetween in which transverse flow of said spent gaseous drying medium can occur without disturbing said coated surface, whereby formation of mottle in said coating is reduced.

* * * * *